United States Patent [19]

Osawa et al.

[11] Patent Number: 4,686,164

[45] Date of Patent: Aug. 11, 1987

[54] ELECTROPHOTOSENSITIVE MEMBER WITH MULTIPLE LAYERS OF AMORPHOUS SILICON

[75] Inventors: Izumi Osawa, Ikeda; Isao Doi, Toyonaka; Toshiya Natsuhara, Amagasaki, all of Japan

[73] Assignee: Minolta Camera Kabushiki Kaisha, Osaka, Japan

[21] Appl. No.: 753,586

[22] Filed: Jul. 10, 1985

[30] Foreign Application Priority Data

Jul. 20, 1984 [JP] Japan ..... 59-151768

[51] Int. Cl.[4] ..... G03G 5/082

[52] U.S. Cl. ..... 430/63; 430/84; 430/95

[58] Field of Search ..... 430/57, 84, 95, 63

[56] References Cited

U.S. PATENT DOCUMENTS

| | | | |
|---|---|---|---|
| 4,394,426 | 7/1983 | Shimizu et al. . | |
| 4,409,308 | 11/1983 | Shimizu et al. . | |
| 4,451,546 | 5/1984 | Kawamura et al. | 430/57 |
| 4,471,042 | 9/1984 | Komatsu et al. . | |
| 4,490,450 | 12/1984 | Shimizu et al. | 430/95 |
| 4,491,626 | 1/1985 | Kawamura et al. | 430/69 |

FOREIGN PATENT DOCUMENTS

| | | |
|---|---|---|
| 115552 | 7/1982 | Japan . |
| 88753 | 5/1983 | Japan . |
| 154850 | 9/1983 | Japan . |

*Primary Examiner*—John L. Goodrow

*Attorney, Agent, or Firm*—Burns, Doane, Swecker & Mathis

[57] ABSTRACT

The present invention relates to a photosensitive member containing an a-Si:Ge layer with an a-Si intermediate layer.

A photosensitive member containing a-Si:Ge has an excellent sensitivity to long wave light so that it is suitable for an electrophotographic system equipped with laser beam printer. However, the sensitivity of the member had not been improved because of their weak dark resistance and lower mobility of carrier in general.

In the present invention, it is provided a photosensitive member having a-Si:Ge layer excellent in the sensitivity to long wave length by controlling the balance between the Ge content and the thickness of the a-Si:Ge layer and the concentration of oxygen or oxygen and carbon in the electroconductive layer.

4 Claims, 6 Drawing Figures

ELECTROPHOTOSENSITIVE MEMBER WITH MULTIPLE LAYERS OF AMORPHOUS SILICON

BACKGROUND OF THE INVENTION

The present invention relates to a photosensitive member having an amorphous silicon photoconductive layer.

Amorphous silicon (hereinafter referred to as a-Si) and/or amorphous silicon:germanium (hereinafter referred to as a-Si:Ge) are superior to the conventional photosensitive members free of environmental pollution and having excellent characteristics in thermal resistance, surface hardness, abrasion resistance as well as in light sensitivity characteristics. Particularly, a-Si/a-Si:Ge laminate-type photosensitive members have an increased absorption coefficient to long wavelength light because the a-Si:Ge layer has a small energy gap as compared with the a-Si layer, and as a result, an effect of extending the photoconductive characteristics to the long-wave region, can be expected.

But, this small energy gap of a-Si:Ge reversely makes the dark resistance of a-Si:Ge smaller than that of a-Si. Consequently, when a-Si and a-Si:Ge are laminated, there occurs a problem that a charge relating capability required for a photosensitive member lowers. While, in incorporating Ge in a-Si for the purpose of sensitization toward long wavelength for the a-Si:Ge layer of a constant thickness, low Ge concentrations make the absorption of long-wave light so poor that great sensitization cannot be expected. And, high Ge concentrations ensure sufficient absorption of the light, but decrease the $\mu\tau$ of generated carriers to cause a reduction in mobility. Also, in the case of a definite Ge concentration, a small thickness of the a-Si:Ge layer makes the absorption of long-wave light so poor that great sensitization cannot be expected. And, a too large thickness ensures sufficient absorption of the light, but makes the $\mu\tau E$ of generated carriers smaller than the thickness of the a-Si:Ge layer to cause a rise in residual potential. Consequently, in order to attain sensitization toward long wavelength most effectively, it is necessary to design so as to keep optimum balance between the Ge concentration and the thickness of the a-Si:Ge layer.

On the other hand, a-Si and a-Si:Ge have a defect that they are too low in the dark resistance to use them as a charge retaining phoconductive layer. For this reason, there is a proposal of increasing the dark resistance by incorporating oxygen and carbon or nitrogen [Japanese Patent Application Kokai (Laid-open) Nos. 145539/1979 and 145540/1979]. But, this proposal has a defect that the light sensitivity characteristics become poor with an increase in the content of the additive, which means that the content needs to be fairly limited. For this reason; there was proposed a method to improve the charge retaining capability by forming a high-resistance a-Si layer containing oxygen and nitrogen or carbon in large amounts on the electroconductive substrate, thereby inhibiting injection of charges from said substrate [Japanese Patent Application Kokai (Laid-open) Nos. 52180/1982, 58160/1982 and 63546/1982]. Surely, the photosensitive member obtained by this method acquired an improved charge retaining capability, but it has the a-Si layer containing oxygen and nitrogen or carbon in large amounts on the electroconductive substrate, so that some of the carriers generated in the photoconductive layer cannot move out to the substrate to cause the rise in residual potential to generate the so-called "fog" on the image.

SUMMARY OF THE INVENTION

It is accordingly a primary object of the present invention to provide a novel photosensitive member having an excellent photoconductivity and a charge retaining capability.

Another object of the present invention is to provide a photosensitive member which has a sensitivity extended to a long wavelength region as well as in a visible light region.

Still another object of the present invention is to provide a photosensitive member which has an excellent charge acceptance and which produces images of good qualities.

These and other objects of the present invention can be accomplished by providing a photosensitive member which comprises on a conductive substrate an intermediate layer of amorphous silicon and a photoconductive layer including at least a layer of amorphous silicon and a layer of amorphous silicon:germanium. The intermediate layer includes at least carbon, oxygen or both carbon and oxygen and a conductivity thereof is so controlled that its majority carrier is opposite in polarity to charges induced in the substrate upon charging. Further the layer of amorphous silicon:germanium is represented by a-$Si_{(1-x)}$:$Ge_xH$ (x: number of Ge atoms expressed by a ratio of Ge/(Si+Ge)) and the relation with its thickness d satisfies the equation of $0.07 \leqq dx^2 \leqq 0.90$.

DETAILED DESCRIPTION OF THE INVENTION

The present invention will be illustrated in detail with reference to FIG. 1.

Figure 1:
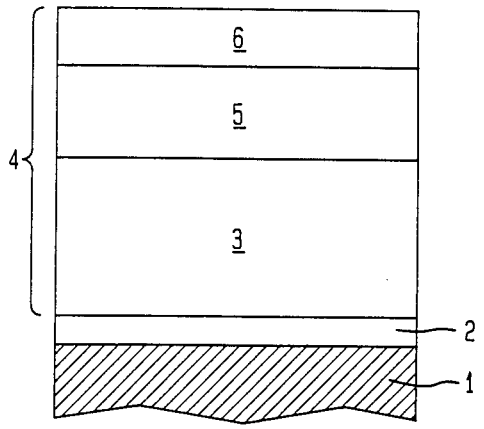
FIG. 1 is a diagram illustrating the fundamental constitution of the photosensitive member of the present invention.

FIG. 1 shows the constitution of a photosensitive member according to the present invention. The photosensitive member comprises an electroconductive substrate (1), an intermediate layer (2) of a-Si and a photoconductive layer (4) in this order.

The intermediate layer (2) of a-Si is directly formed on the substrate and contains at least oxygen or carbon and further the polarity adjusting atom of the Group III A or VA impurity of the Periodic Table.

The photoconductive layer (4) formed on the intermediate layer (2) includes a first layer (3) of a-Si, an a-Si:Ge layer (5) and a second layer (6) of a-Si forming the surface layer. Although it is best to sandwich the a-Si:Ge layer (5) with said first and second layers of a-Si as shown, the a-Si:Ge layer (5) may be formed in direct contact with the intermediate layer (2) by omitting the first layer (3) or may be formed as the surface layer by omitting the second layer (6).

Said intermediate layer (2) is formed in a thickness of about 30 Å to 2 μm, preferably 50 to 5000 Å, most preferably 100 to 2000 Å, for example, by the decomposition method with glow discharge. The intermediate layer (2) contains at least oxygen or carbon, and with the object of adjusting its polarity so that charges having an opposite polarity to that of charges led to the electroconductive substrate side (1) by charging shall be the majority carrier, it is prepared by adding a polarity-adjusting substance of the Group III A or VA atom of the Periodic Table (preferably boron for positive charging, an boron or phosphorus for negative charging) to the intermediate layer (2). The intermediate layer when containing oxygen is represented by $(a\text{-}Si_xO_{1-x})_yH_{1-y}$ wherein x is 0.6 to 0.99 and y is 0.5 to 0.95. This is to say that the oxygen content is about 0.01 to 40 at.%. In the case of incorporating carbon, the formula of $(a\text{-}Si_xC_{1-x})_yH_{1-y}$ applies wherein x is 0.4 to 0.95 and 0.5 to 0.95 for y. Incorporation of carbon or oxygen in the intermediate layer (2) remarkably improves the dark resistance to effectively prevent injection of charges from the substrate (1). Also, incorporation of oxygen or carbon is effective to improve the coating property and leveling property of the layer (2) in co-operation with the substrate (2) and to strengthen adhesion between the both. But, incorporation of oxygen or carbon alone, particularly with a large amount causes a rise in residual potential, and therefore in the present invention, the layer (2) contains a polarity-adjusting substance in addition to oxygen or carbon. As the polarity adjusting substance, an element in Group III A or VA of the Periodic Table, preferably boron or phosphorous, may be used. A preferred content of the substance is 10 to 20000 ppm of boron for positive charging, and up to 20 ppm of boron or up to 50 ppm of phosphorus for negative charging. The boron content of 10 to 20 ppm overlaps for both positive and negative chargings. But this amount makes the layer (2) generally intrinsic and both holes and electrons are movable. Incorporation of the polarity-adjusting substance permits carriers generated in the photoconductive layer (4) to move into the electroconductive substrate side, thereby preventing a rise in residual potential. Considering the case of positively charging the photosensitive member of FIG. 1 with 10 to 20000 ppm of boron in the intermediate layer (2), the charge carriers of holes and electrons will be generated by the a-Si:Ge layer (5) upon exposure to a long wavelength light of 780 nm. The electrons move toward the surface of second layer (6) to neutralize positive charges whereas holes move toward the intermediate layer (2). As this layer (2) is controlled to P-type or at least intrinsic by the incorporation of boron, the majority carrier will be hole and therefore, holes move therethrough to escape to the substrate without being trapped. It is best that boron content be more than 100 ppm to assure the majority carrier to be hole for positive charging. The reason why the oxygen content is determined to be about 0.01 to about 40 at% is that oxygen contents less than 0.01 at% cannot increase the resistance of the intermediate layer, and that oxygen contents more than 40 at%, although boron is contained in the layer, cause a rise in residual potential to generate fog on the image. The carbon content should be 5 to 60 at.% for the substantially same reason as the oxygen. The amount of boron of 10 to 20000 ppm, preferably 100 to 20000 ppm, for positive charging and less than 20 ppm of boron or less than 50 ppm of phosphorous for negative charging should preferably control the conductivity of the intermediate layer to either P- or N-type. Boron contents more than 20000 ppm and phosphorus contents more than 50 ppm cause a sudden reduction in the charge retainability of photosensitive members.

The intermediate layer (2) may contain both oxygen and carbon to form the layer of $(a\text{-}Si_{1-x-y}C_xO_y)_{1-z}H_z$ where x is 0.05 to 0.6, y is 0.01 to 0.4 and z is 0.5 to 0.95. In particular, oxygen of 0.01 to 40 at.% and carbon of 5 to 60 at.%. However, Si should not be zero and $Si_{1-x-y}$ should at least be $Si_{0.1}$. By incorporating carbon and oxygen in the intermediate layer, the dark resistance of the layer remarkably increases to effectively prevent injection of charges at the electroconductive substrate. Also, incorporation of carbon and oxygen is effective to improve the covering property and leveling property of the layer (2) in co-operation with the substrate (2) and to strengthen adhesion between the both. For the same reasons as above, this intermediate layer (2) of a-Si with oxygen and carbon contains 10 to 20000 ppm, preferably 100 to 20000 ppm of boron for positive charging and less than 20 ppm of boron or less than 50 ppm of phosphorous for negative charging. A preferred content of the substance is 10 to 20000 ppm of boron for positive charging, and up to 20 ppm of boron or up to 50 ppm of phosphorus for negative charging. The reason why the carbon content is determined to be 5 to 60 at% is that carbon contents less than 5 at% cannot increase the resistance of the intermediate layer, and that carbon contents more than 60 at% generate fog on the image. Further, oxygen contents more than 40 at% raise the residual potential and generate fog on the image. Incorporation of boron or phosphorus is for the purpose of causing charges having an opposite polarity to that of charges led to the electroconductive substrate side by charging to constitute majority carrier.

The photoconductive layer (4) containing at least a-Si is similarly formed in a thickness of 5 to 100 μm, preferably 10 to 60 μm on the intermediate layer (2), for example, by the decomposition method with glow discharge. This photoconductive layer includes the a-Si:Ge layer (5) of 100 Å to 20 μm, preferably 0.5 to 10 μm thick and it generate charge carriers by exposure to a long wavelength light. A relationship between the thickness d of the a-Si:Ge layer (5) which is represented by $a\text{-}Si_{1-x}\text{:}Ge_xH$ (x: number of Ge atoms expressed by a ratio of Ge/(Ge+Si)) and the Ge concentration x satisfied the following equation:

$$0.07 \leqq dx^2 \leqq 0.90 \quad (1)$$

The thickness d is generally large when x is small or vice versa. The inclusion of a large amount of Ge will require less thickness of the layer (3) whereas a small amount of Ge will require more thickness. That is, when the thickness, d, of the $a\text{-}Si_{1-x}\text{:}Ge_x$ layer is definite, a too small composition ratio, x, of Ge ($dx^2<0.07$) makes the absorption of long-wave light so poor that great sensitization cannot be expected. While, a too large x ($dx^2>0.90$) ensures sufficient absorption of the light, but decreases the $\mu\tau$ of generated carriers at the $a\text{-}Si_{1-x}\text{:}Ge_x$ layer to cause a reduction in mobility. Also, in the case of a definite composition ratio, x, of Ge, a too small thickness, d ($dx^2<0.07$), of the $a\text{-}Si_{1-x}\text{:}Ge_x$ layer makes the absorption of long-wave light so poor that great sensitization cannot be expected. And, a too large thickness, d ($dx^2>0.90$), makes the $\mu\tau E$ of generated carriers smaller than the thickness of $a\text{-}Si_{1-x}\text{:}Ge_x$ layer ($\mu\tau E/E/d<1$) to cause a rise in residual potential. Further, when $dx^2$ is smaller than 0.07, long-wave light is not absorbed sufficiently, and as a result, interference phenomenon appears in the photoconductive layer to bring about defects on the image. When $dx^2$ is more than 0.90, the charge retainability suddenly decreases.

From the things described above, the best design of the a-$Si_{1-x}$:$Ge_x$ layer can be carried out by setting the above upper limit (0.90) and low limit (0.07) to the product of the thickness, d, of the a-$Si_{1-x}$:$Ge_x$ layer and the square of the composition ratio, x, of Ge. Also, if all the a-Si:Ge layers satisfy the equation (1) as a whole, the photoconductive layer (4) may be arranged in multi-layers.

In the photosensitive member of the above constitution, an a-Si overcoat layer containing at least carbon or carbon and oxygen, which is a surface-protecting layer, may be formed if necessary on the photoconductive layer (4).

It should be noted that the photoconductive layer (4) may contain a suitable amount of oxygen, nitrogen and/or carbon and further boron or phosphorous to further improve the photosensitivity and dark resistance.

According to the present invention, electrophotosensitive members superior in any of photoconductivity, charge retaining property and surface hardness are obtained. And particularly, those having a high sensitivity toward any of the visible light region and near infrared region can be obtained.

REFERENCE EXAMPLES 1 TO 3

Three a-Si/a-Si:ge multi-layer photosensitive members are produced as usual by glow discharge. That is, three photosensitive members A, B, C each having the same construction as the one shown in FIG. 1 but without the intermediate layer (2) were formed. The a-Si photoconductive layer (4) in Table 1 is inclusive of layers (3), (5) and (6) and conditions for a-Si:Ge layer (5) were varied to change $dx^2$ for each photosensitive member. The condition for producing each layer is shown in Table 1.

TABLE 1

| | a-Si photo-conductive layer (4) | a-Si:Ge layer (5) Photo-sensitive member A | Photo-sensitive member B | Photo-sensitive member C |
|---|---|---|---|---|
| Total amount (carrier gas:$H_2$) | 600 cc | 600 cc | 600 cc | 600 cc |
| $SiH_4$ | 100 cc | 100 cc | 100 cc | 100 cc |
| $B_2H_6/SiH_4$ | 10 ppm | 10 ppm | 10 ppm | 10 ppm |
| $O_2/SiH_4$ | 1/100 | 1/100 | 1/100 | 1/100 |
| $\frac{GeH_4}{SiH_4 + GeH_4}$ | — | 1/6 (x ≅ 0.3) | 1/6 (x ≅ 0.3) | 1/3 (x ≅ 0.5) |
| $T_s$ | 250° C. | 250° C. | 250° C. | 250° C. |
| High-freguency (13.56 MHz) power | 250 W | 250 W | 250 W | 250 W |
| Gas pressure on operation | 1.0 Torr | 1.0 Torr | 1.0 Torr | 1.0 Torr |
| Thickness | 25-30 μm | ~0.5 | ~5.0 | ~5.0 |
| $dx^2$ | | 0.045 | 0.45 | 1.250 |

Figure 2:
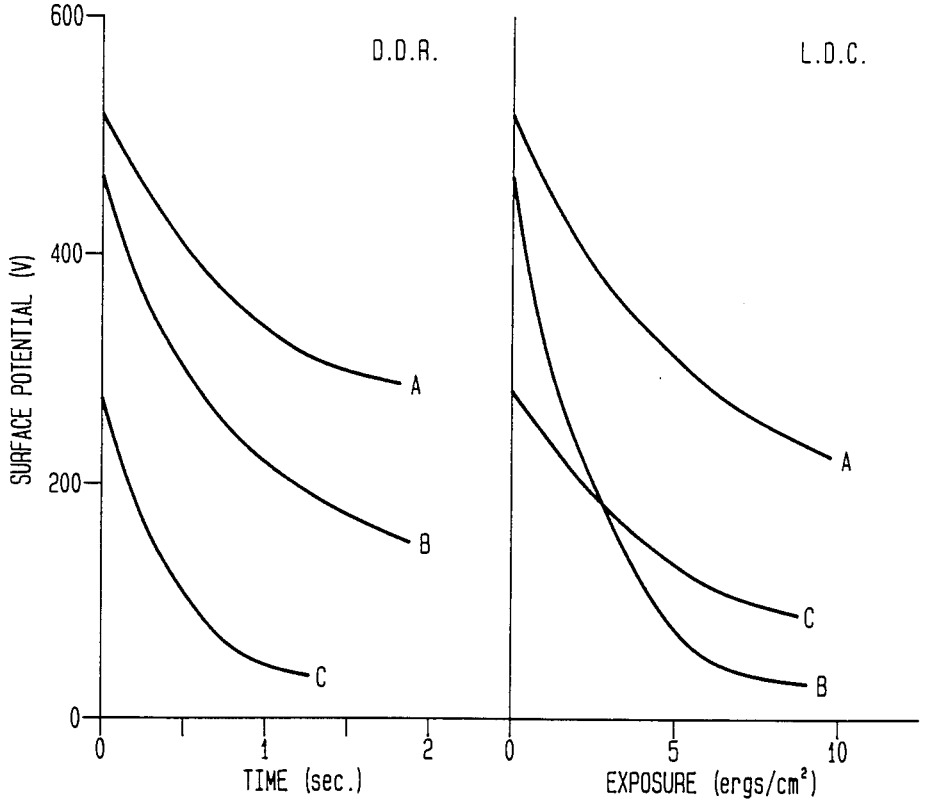
FIGS. 2 to 6 are graphs illustrating the electrostatic characteristics of the photosensitive member of the present invention.

The photosensitive members A, B and C are produced by determining the feed amount of $GeH_4$ ($GeH_4/SiH_4+GeH_4$) and the thickness of the a-Si:Ge layer so that $dx^2$ is 0.045, 0.450 and 1.250, respectively. The electrostatic characteristics [dark decay rate (DDR), light decay curve (LDC) (777 nm)] of the photosensitive members are shown in FIG. 2.

As apparent from the above result, with an increase in $dx^2$ (0.045→0.450→1.250), the charge retainability lowers and also DDR increases. Particularly, this tendency is remarkable for the photosensitive member C of which the a-Si:Ge layer is produced so that $dx^2$ is 1.250. In the case of the photosensitive member A of which the a-Si:Ge layer is produced so that $dx^2$ is 0.045, both the charge retainability and DDR are on a level at which there is no problem in practical use, but as compared with the common a-Si photosensitive member for PPC, its sensitivity toward long wavelength is not much increased and also defects due to the interference phenomenon appear on the image. On the other hand, as to the photosensitive member B ($dx^2=0.450$) of which the a-Si:Ge layer is produced so that an equation, $0.07 \leqq dx^2 \leqq 0.90$, applies, it tends to be somewhat inferior in the charge retainability and DDR as compared with the photosensitive member A, but its sensitivity toward long wavelength is increased and defects due to the interference phenomenon do not appear on the image.

EXAMPLES 1 AND 2

Two photosensitive member D and E are produced as usual under the conditions shown in Table 2. The photosensitive member D has the same construction as that the one shown in FIG. 1, i.e., from the surface side, it includes a-Si layer (6)/a-Si:Ge layer (5)/a-Si layer (3)/a-Si intermediate layer (2)/A1 substrate (1). In Table 1, a-Si photoconductive layer is inclusive of layers (6), (5) and (3) for this photosensitive member D. The photosensitive member E is the same as D but without the a-Si layer (3) and while the entire thickness of the photoconductive layer (4) is the same as D, the a-Si layer (6) has increased thickness. Thus, for the member E, a-Si photoconductive layer in Table 1 is inclusive of layers (5) and (6) only.

TABLE 2

| | a-Si photo-conductive layer (4) | a-Si:Ge layer (5) | a-Si($O_2$) inter-mediate layer (2) |
|---|---|---|---|
| Total amount (carrier gas:$H_2$) | same as Reference example 2 (photo-sensitive member B) | same as Reference example 2 (photo-sensitive member B) | 600 cc |
| $SiH_4$ | | | 100 cc |
| $B_2H_6/SiH_4$ | | | 400 ppm |
| $O_2/SiH_4$ | | | 1/30 (~5 at %) |
| $\frac{GeH_4}{SiH_4 + GeH_4}$ | | | — |
| $T_s$ | | | 250° C. |
| High-freguency (13.56 MHz) power | | | 250 W |
| Gas pressure on operation | | | 1.0 Torr |
| Thickness | | | ~0.3 μm |

Figure 3:
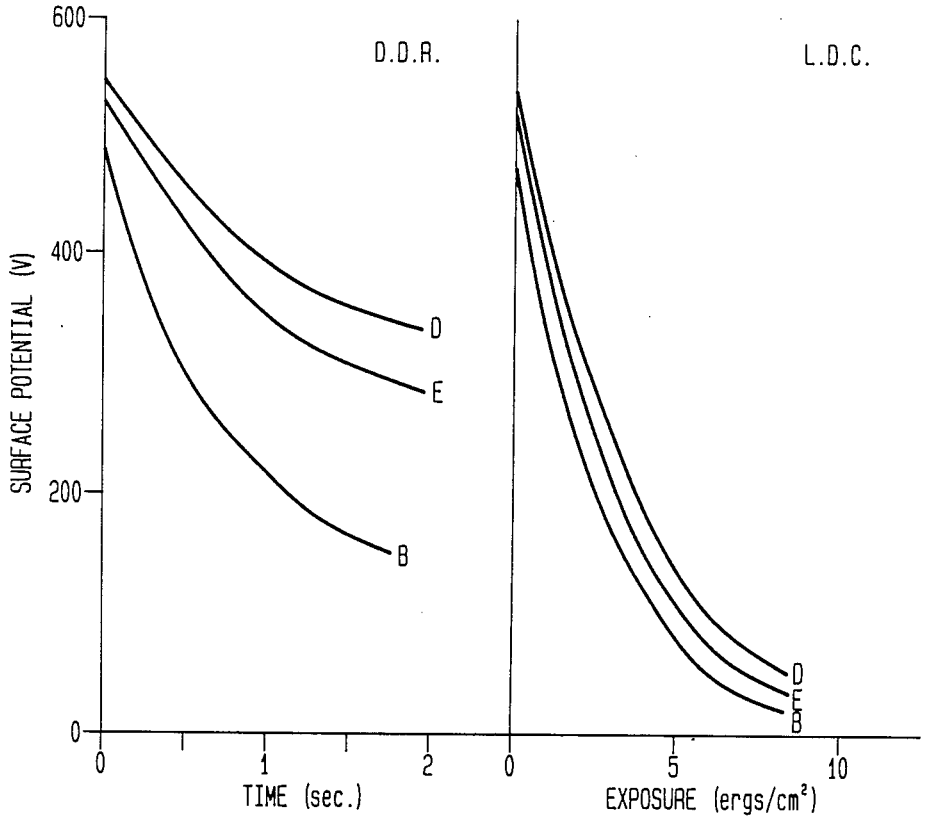

The electrostatic characteristics (DDR, LDC) of the photosensitive members D and E are shown in FIG. 3.

As apparent from FIG. 3, the photosensitive members D and E, as compared with the photosensitive member B, show improvement in the charge retainability and also recovery (reduction) in DDR because injection of charges at the electroconductive substrate can effectively be prevented. They have almost the same degree of excellent sensitivity toward long wavelength as that of the photosensitive member B, and produce no defects due to the interference phenomenon on the image.

EXAMPLES 3 AND 4

Two photosensitive members F and G having the same structure (shown in FIG. 1) as that of the photosensitive member D of Example 1 are produced under the conditions described in Table 3, provided that the a-Si($O_2$) intermediate layer (2) of the former F has an increased oxygen content, and the a-Si($O_2$) intermediate layer (2) of the latter G has an increased amount of $B_2H_6$.

Figure 4:
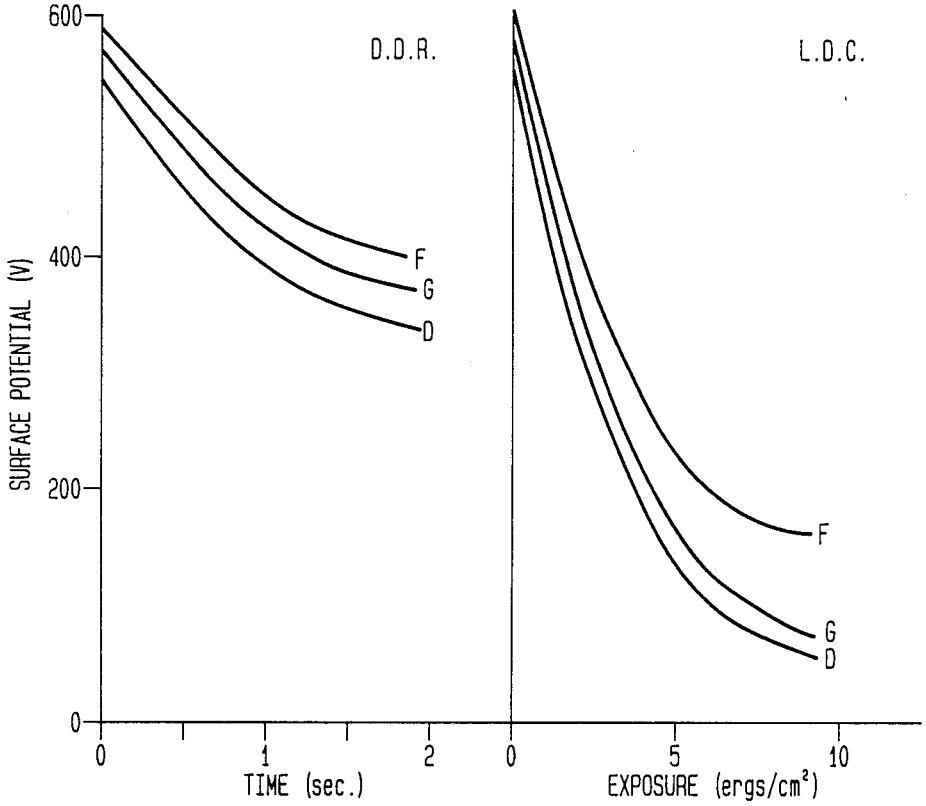

The electrostatic characteristics (DDR, LDC) of the photosensitive members F and G are shown in FIG. 4.

TABLE 3

| | a-Si photo-conductive layer (4) | a-Si:Ge layer (5) | a-Si($O_2$) intermediate layer (2) Photo-sensitive member F | a-Si($O_2$) intermediate layer (2) Photo-sensitive member G |
|---|---|---|---|---|
| Total amount (carrier gas:$H_2$) | same as Reference example 2 (photo-sensitive member B) | same as Reference example 2 (photo-sensitive member B) | 600 cc | 600 cc |
| $SiH_4$ | | | 100 cc | 100 cc |
| $B_2H_6/SiH_4$ | | | 400 ppm | 1000 ppm |
| $O_2/SiH_4$ | | | 1/6 (~25 at %) | 1/6 (~25 at %) |
| $\frac{GeH_4}{SiH_4 + GeH_4}$ | | | — | — |
| $T_s$ | | | 250° C. | 250° C. |
| High-freguency (13.56 MHz) power | | | 250 W | 250 W |
| Gas pressure on operation | | | 1.0 Torr | 1.0 Torr |
| Thickness | | | ~0.3 μm | ~0.3 μm |

As apparent from FIG. 4, the photosensitive members F and G have almost the same degree of excellent charge retainability and DDR as those of the photosensitive member D, but the former F shows a rise in residual potential and gives fog to the image. While, as to the photosensitive member G of which the intermediate layer contains as an increased amount of $B_2H_6$ as 1000 ppm, the residual potential lowers to a level at which there is no problem in practical use, the sensitivity toward long wavelength is as excellent as the photosensitive member D and there are no defects due to the interference phenomenon on the image.

EXAMPLE 5

A photosensitive member H having a a-Si(C+$O_2$) intermediate layer in place of the a-Si($O_2$) layer [(2) in FIG. 1] of the photosensitive member D in Example 1, is produced under the condition shown in Table 4.

TABLE 4

| | a-Si photo conductive layer (4) | a-Si:Ge layer (5) | a-Si(C + $O_2$) intermediate layer (2) |
|---|---|---|---|
| Total amount (carrier gas:$H_2$) | same as Reference example 2 (photo-sensitive member B) | same as Reference example 2 (photo-sensitive member B) | 600 cc |
| $SiH_4$ | | | 100 cc |
| $B_2H_6/SiH_4$ | | | 600 ppm |
| $O_2/SiH_4$ | | | 1/30 (~5 at %) |
| $C_2H_4/SiH_4$ | | | 1/1 (~40 at %) |
| $\frac{GeH_4}{SiH_4 + GeH_4}$ | | | — |
| $T_s$ | | | 250° C. |
| High-freguency (13.56 MHz) power | | | 250 W |
| Gas pressure on operation | | | 1.0 Torr |
| Thickness | | | ~0.3 μm |

Figure 5:
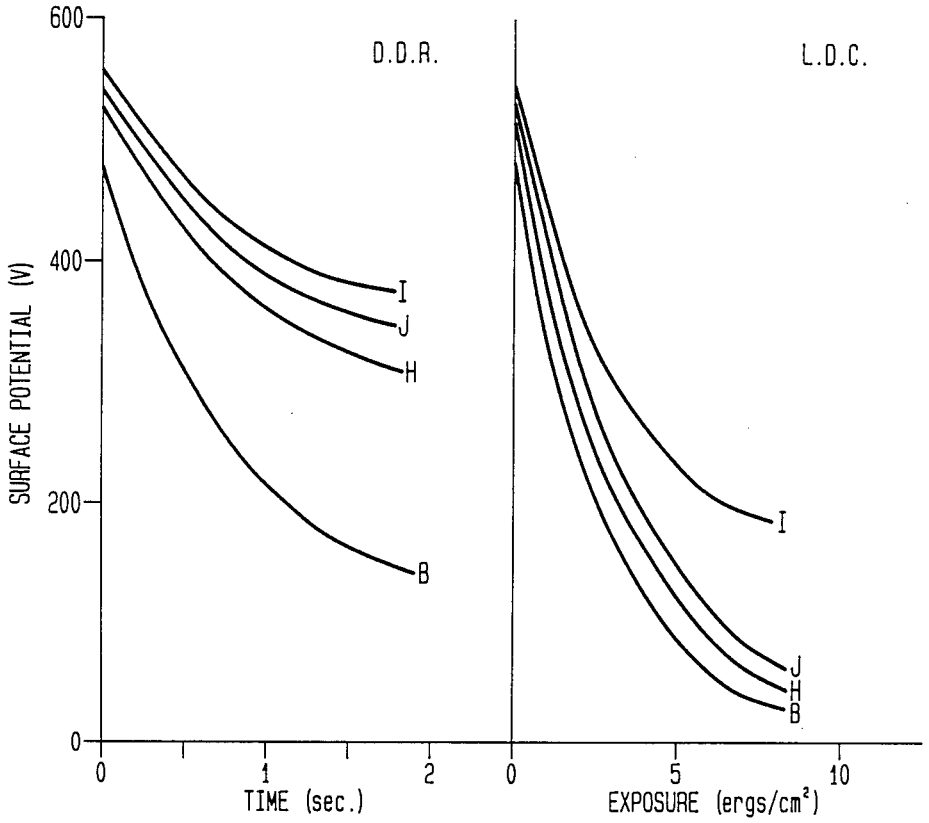

The electrostatic characteristics (DDR, LDC) of the photosensitive member H are shown in FIG. 5.

As apparent from FIG. 5, the photosensitive member H having an a-Si(C+$O_2$) intermediate layer, as compared with the photosensitive member B, shows improvement in the charge retainability and also recovery (reduction) in DDR because injection of charges at the electroconductive substrate can effectively be prevented. It has almost the same degree of excellent sensitivity toward long wavelength as that of the photosensitive member B, and produces no defects due to the interference phenomenon on the image.

EXAMPLES 6 AND 7

The photosensitive members I and J having the same structure as that of the photosensitive member H in Example 5 are produced under the conditions shown in Table 5, provided that the a-Si(C+$O_2$) intermediate layer of the former I has an increased oxygen content, and the a-Si(C+$O_2$) intermediate layer of the latter J has an increased amount of $B_2H_6$.

The electrostatic characteristics (DDR, LDC) of the photosensitive members I and J are shown in FIG. 5.

TABLE 5

| | a-Si photo-conductive layer (4) | a-Si:Ge layer (5) | a-Si(C + $O_2$) intermediate layer (2) Photo-sensitive member I | Photo-sensitive member J |
|---|---|---|---|---|
| Total amount (carrier gas:$H_2$) | same as Reference example 2 (photo-sensitive member B) | same as Reference example 2 (photo-sensitive member B) | 600 cc | 600 cc |
| $SiH_4$ | | | 100 cc | 100 cc |
| $B_2H_6/SiH_4$ | | | 600 ppm | 1500 ppm |
| $O_2/SiH_4$ | | | 1/6 (~25 at %) | 1/6 (~25 at %) |
| $C_2H_4/SiH_4$ | | | 1/1 (~40 at %) | 1/1 (~40 at %) |
| $\frac{GeH_4}{SiH_4 + GeH_4}$ | | | — | — |
| $T_s$ | | | 250° C. | 250° C. |
| High-freguency (13.56 MHz) power | | | 250 W | 250 W |
| Gas pressure on operation | | | 1.0 Torr | 1.0 Torr |
| Thickness | | | ~0.3 μm | ~0.3 μm |

As apparent from FIG. 5, the photosensitive members I and J have almost the same degree of excellent charge retainability and DDR as those of the photosensitive member H, but the former I shows a rise in residual potential and gives fog to the image. While, as to the photosensitive member J of which the intermediate layer contains as an increased amount of $B_2H_6$ as 1500 ppm, the residual potential lowers to a level at which there is no problem in practical use, the sensitivity toward long wavelength is an excellent as the photosensitive member H and there are no defects due to the interference phenomenon on the image.

EXAMPLE 8

The photosensitive member K having the same construction as the photosensitive member D in Example 2 but containing carbon in place of oxygen in the a-Si intermediate layer was produced as shown in table 6.

TABLE 6

| | a-Si photo-conductive layer (4) | a-Si:Ge layer (5) | a-Si(C) inter-mediate layer (2) |
|---|---|---|---|
| Total amount (carrier gas:$H_2$) | same as Reference example 2 (photo-sensitive member B) | same as Reference example 2 (photo-sensitive member B) | 600 cc |
| $SiH_4$ | | | 100 cc |
| $B_2H_6/SiH_4$ | | | 200 ppm |
| $O_2/SiH_4$ | | | — |
| $C_2H_4/SiH_4$ | | | 1/1 (~40 at %) |
| $\frac{GeH_4}{SiH_4 + GeH_4}$ | | | — |
| $T_s$ | | | 250° C. |
| High-freguency (13.56 MHz) power | | | 250 W |
| Gas pressure on operation | | | 1.0 Torr |

TABLE 6-continued

| | a-Si photo-conductive layer (4) | a-Si:Ge layer (5) | a-Si(C) inter-mediate layer (2) |
|---|---|---|---|
| Thickness | | | ~0.3 μm |

Figure 6:
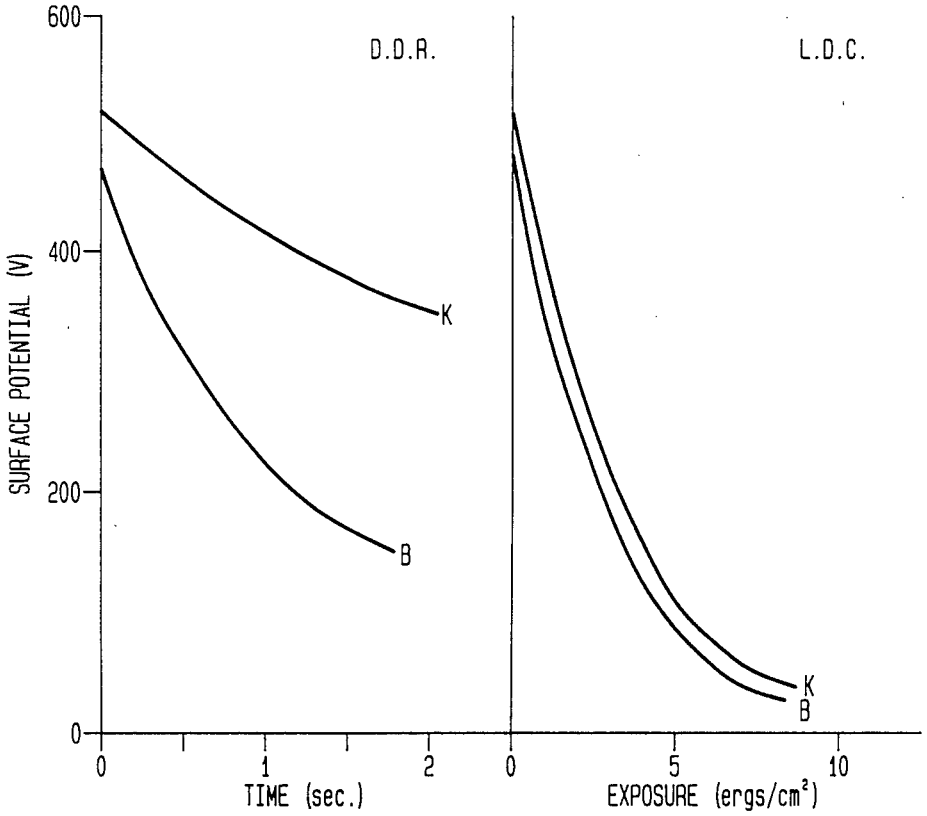

The electrostatic characteristics (DDR, LDC) of the photosensitive member K together with B are shown in FIG. 6.

As apparent from FIG. 6, the photosensitive member K has improved charge retainability and a sensitivity toward the long wavelength region.

What is claimed is:

1. An electrophotosensitive member which comprises:

a conductive substrate;

an intermediate layer of amorphous silicon formed on said conductive substrate and including oxygen or carbon and an element in Group III A or VA of the Periodic Table in an amount to control the conductivity thereof to a polarity opposite to the polarity of charges induced in said substrate upon charging wherein said intermediate layer has a thickness of 30 Å to 2 μm and including 0.01 to 40 atomic % of said oxygen or 5 to 60 atomic % of said carbon; and a photoconductive layer formed on said intermediate layer and including a first amorphous silicon layer, an amorphous silicon:germanium layer formed on said first amorphous silicon layer and having a composition represented by a-$Si_{1-x}$:$Ge_xH$, the thickness d of said amorphous silicon:germanium layer satisfying a condition of $0.07 \leqq dx^2 \leqq 0.90$, and a second amorphous silicon layer formed on said amorphous silicon:germanium layer.

2. A photosensitive member as claimed in claim 1 wherein said Group III A element is boron and Group VA element is phosphorous.

3. A photosensitive member as claimed in claim 2 wherein boron is included in the amount of 10 to 20000 ppm in said intermediate layer for positive charging.

4. A photosensitive member as claimed in claim 2 wherein boron is included in the amount less than 20 ppm or phosphorous of less than 50 ppm in said intermediate layer for negative charging.

* * * * *